US006135512A

United States Patent [19]

Galvin

[11] Patent Number: 6,135,512

[45] Date of Patent: Oct. 24, 2000

[54] AUTOMATIC DOOR LATCH

[76] Inventor: Donna Galvin, 21 Colwyn La., Bala Cynwyd, Pa. 19004

[21] Appl. No.: 09/097,279

[22] Filed: Jun. 12, 1998

[51] Int. Cl.[7] ..... E05C 1/08

[52] U.S. Cl. ..... 292/163; 292/173; 292/244; 292/335

[58] Field of Search ..... 292/163, 173, 292/143, DIG. 26, DIG. 4, 139, 244, 332, 334, 335, 175, 359

[56] References Cited

U.S. PATENT DOCUMENTS

| | | | |
|---|---|---|---|
| 463,031 | 11/1891 | Edwards . | |
| 1,553,531 | 9/1925 | Hoffman . | |
| 1,816,134 | 7/1931 | Wood | 292/173 |
| 2,733,093 | 1/1956 | Reitzel . | |
| 3,774,420 | 11/1973 | Orr . | |
| 3,870,354 | 3/1975 | Prahl . | |
| 3,912,309 | 10/1975 | Fischer et al. | 292/335 |
| 3,917,329 | 11/1975 | Fujiki et al. . | |
| 4,124,238 | 11/1978 | Bischoff, Jr. | 292/173 |
| 4,318,558 | 3/1982 | Best et al. | 292/173 |
| 4,512,597 | 4/1985 | Nabb et al. | 292/143 |
| 4,561,684 | 12/1985 | Marotto . | |
| 4,664,433 | 5/1987 | Solovieff | 292/337 |
| 4,671,549 | 6/1987 | Marotto et al. . | |
| 4,683,733 | 8/1987 | Marin . | |
| 4,890,870 | 1/1990 | Miron . | |
| 4,945,737 | 8/1990 | Hart . | |
| 4,974,884 | 12/1990 | Dietrich | 292/173 |
| 5,009,456 | 4/1991 | Eck | 292/173 |
| 5,044,182 | 9/1991 | Totten . | |
| 5,058,940 | 10/1991 | Hart | 292/167 |
| 5,152,558 | 10/1992 | Smith et al. | 292/1.5 |
| 5,368,345 | 11/1994 | Watts . | |
| 5,516,160 | 5/1996 | Kajuch . | |
| 5,615,919 | 4/1997 | Ivey . | |

FOREIGN PATENT DOCUMENTS

| | | |
|---|---|---|
| 506454 | 8/1920 | France . |

*Primary Examiner*—Lynne H. Browne
*Assistant Examiner*—John B. Walsh
*Attorney, Agent, or Firm*—Alan G. Towner; Eckhert Seamans Cherin & Mellott, LLC

[57] ABSTRACT

An automatic door latch is disclosed. In a preferred embodiment, the latch includes a dead bolt which is automatically moved from a partially retracted or trigger position to a fully extended locking position when a door in which the lock is mounted is closed. When a key is used to unlock the dead bolt from outside of the door, or a finger turn or key is used to unlock the dead bolt from inside of the door, the dead bolt is automatically reset to the trigger position. In a preferred embodiment, the dead bolt lock includes a multi-position switch mounted in the lock housing which engages a contact member mounted on the dead bolt. Retraction of the dead bolt into the housing causes the multi-position switch to engage the contact member and to secure the dead bolt in the trigger position. Subsequent retraction of the dead bolt into the housing causes the multi-position switch to disengage from the contact member, thereby allowing the dead bolt to extend from the housing to the locked position. In a preferred embodiment, a latch restraint assembly is provided which holds the dead bolt in the fully retracted position until the restraint assembly is manually released. The automatic door latch comprises relatively few component parts in comparison with conventional locks, and is preferably compatible with standard predrilled door cutouts.

32 Claims, 8 Drawing Sheets

AUTOMATIC DOOR LATCH

FIELD OF THE INVENTION

The present invention relates to door latches, and more particularly relates to automatic door latches such as dead bolt locks.

BACKGROUND INFORMATION

Dead bolt locks are often used to secure doors. A typical dead bolt lock includes a bolt which extends from the door into an opening in a strike plate mounted in the door frame. In manual locks, the dead bolt is extended and retracted by a key from outside of the door, or by a key or handle from inside of the door. Although manual dead bolt locks provide increased security, they are inconvenient because a key must be used to lock the dead bolt after an individual has exited the door, or a key or handle must be used to lock the dead bolt from inside of the door. As a result, manual dead bolts are not always consistently locked.

Several types of dead bolt locks have been proposed in which the dead bolt is automatically locked when the door is closed. Examples of such automatic dead bolt locks are disclosed in U.S. Pat. Nos. 4,561,684, 4,671,549, 4,890,870, 4,945,737, 5,044,182, 5,516,160 and 5,615,919. Each of these patents is incorporated herein by reference.

Although conventional automatic dead bolt locks can provide increased usage in comparison with manual locks, they tend to be complex and require a large number of component parts. The requirement of many component parts adds to the cost of conventional locks, and also makes the locks susceptible to damage or failure during installation and use. In particular, conventional locks having components mounted on the exterior of the lock housing may be easily damaged during installation. Furthermore, some types of conventional automatic dead bolt locks require a mortise assembly for mounting on a door. In addition, conventional automatic dead bolt locks often are not compatible with standard predrilled door cut-outs. Another disadvantage of existing automatic dead bolt lock designs is that they often require the use of separate triggers or sensing pins. Such triggers and sensing pins typically require modifications to the door such as additional borings, or require the use of a hollow dead bolt to accommodate the components.

The present invention has been developed in view of the foregoing, and to address other deficiencies of the prior art.

SUMMARY OF THE INVENTION

An aspect of the present invention is to provide an automatic door latch. The latch includes: a housing; a latch retractably mounted in the housing and movable to an extended position, a partially retracted position and a fully retracted position; a spring biasing the latch toward the extended position; an actuator for moving the latch to the fully retracted position; a contact member mounted on the latch; and a multi-position switch mounted on the housing in releasable contact with the contact member. The multi-position switch allows the latch to move to the extended position when the multi-position switch is in a first or intermediate position, and holds the latch in the partially retracted position when the multi-position switch is in a second or extended position. The latch is preferably a dead bolt lock.

Another aspect of the present invention is to provide an automatic door latch including components mounted inside the housing of the latch. The components hold the latch in a partially retracted trigger position when the door is open, and allow the latch to move to an extended locking position when the door is closed.

A further aspect of the present invention is to provide an automatic door latch restraint assembly which manually secures the latch in a fully retracted unlocked position when automatic locking of the latch is not desired.

These and other aspects of the present invention will become more apparent from the following description.

DESCRIPTION OF THE PREFERRED EMBODIMENTS

Figure 1:
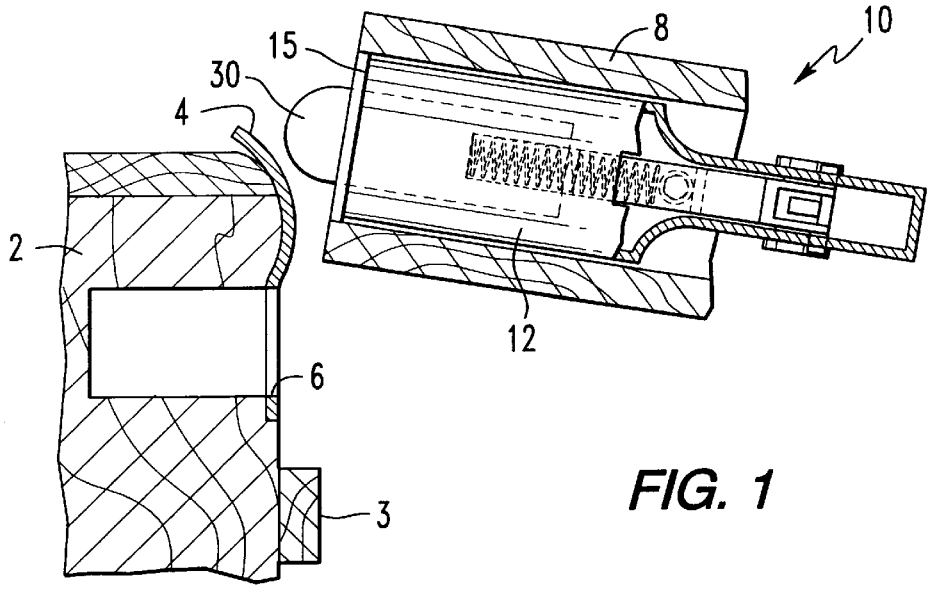
FIGS. 1–3 are partially schematic top sectional views illustrating the operation of an automatic dead bolt lock in accordance with an embodiment of the present invention.
Figure 2:
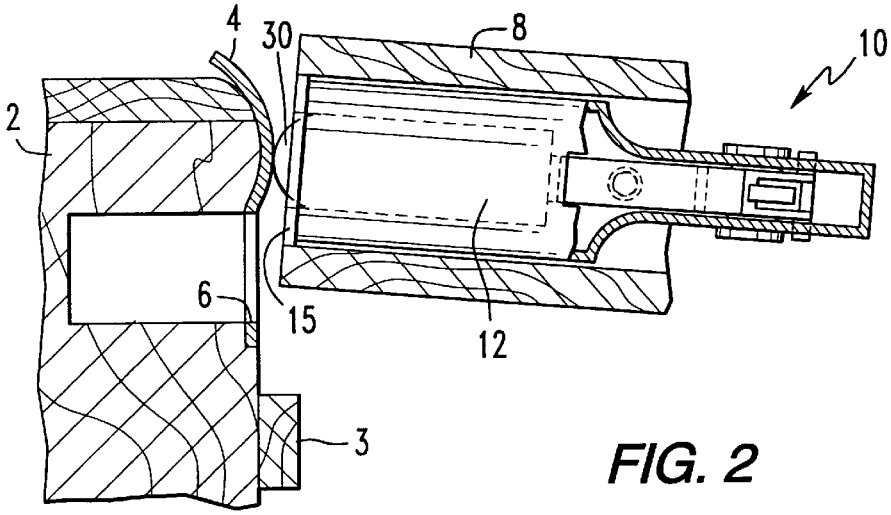
Figure 3:
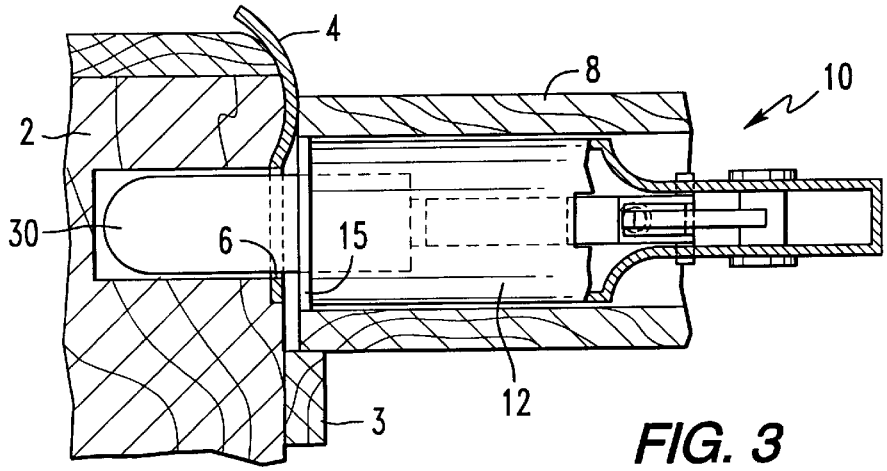

FIGS. 1–3 schematically illustrate the operation of an automatic door latch in accordance with an embodiment of the present invention. A door frame 2 includes a door stop 3 and a strike plate 4 mounted thereon. A strike box 6 is formed through an opening in the strike plate 4 and a cut-out in the door frame 2. A door 8 of any conventional construction includes an automatic door latch 10 in the form of a dead bolt lock mounted therein. The door latch 10 includes a housing 12 and a face plate 15. The face plate 15 is preferably mounted substantially flush with the edge of the door 8. A retractable latch in the form of a dead bolt 30 extends from the housing 12 and face plate 15 of the door latch 10. The dead bolt 30 is spring-biased toward an extended position.

As used herein, the term "latch" includes dead bolts, bolts, latching bolts and the like. While dead bolt locks are primarily described herein, it is to be understood that other types of latches are within the scope of the invention.

In the position shown in FIG. 1, in which the door 8 is open, the dead bolt 30 is in a partially retracted or trigger position. As the door 8 moves from the open position shown in FIG. 1 to the position shown in FIG. 2, the dead bolt 30 contacts the strike plate 4 and is forced into the housing 12. In the embodiment shown in FIGS. 1–3, the strike plate 4 includes a raised curved portion which contacts the dead bolt 30. However, any other suitable strike plate configuration which forces the dead bolt 30 inward upon contact with the strike plate may be used. As the door 8 moves from the position shown in FIG. 2 to the closed position shown in FIG. 3, the dead bolt 30 is automatically extended into the strike box 6. In this manner, the door latch 10 automatically extends and locks the dead bolt 30 when the door 8 is closed.

As more fully described below, the dead bolt 30 may be manually retracted from the locked position shown in FIG. 3 through the use of a key outside the door, or a finger turn or key inside the door. In another embodiment where the door latch is provided in the form of a locking knob set, the dead bolt or other type of latch may be manually retracted from the locked position through the use of a key inserted in the exterior knob, or rotation of an interior knob or handle.

Figure 4:
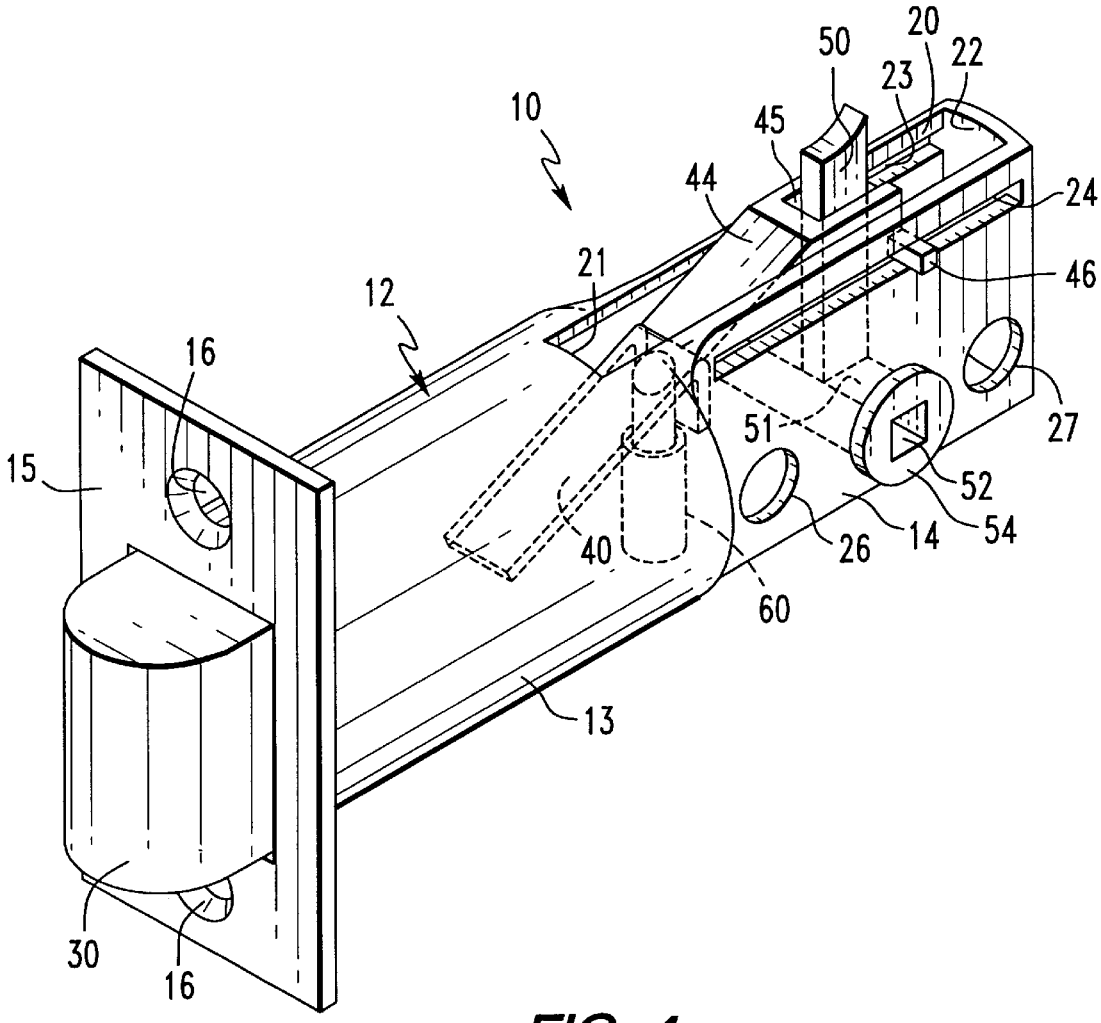
FIG. 4 is a partially schematic isometric view of an automatic dead bolt lock in accordance with an embodiment of the present invention.

FIG. 4 is a partially schematic isometric view of the automatic door latch 10 in accordance with an embodiment of the present invention. The door latch 10 includes a housing 12 having a generally cylindrical front portion 13 and a generally rectangular rear portion 14. The housing 12 may be made of any suitable material such as metal. For example, the housing 12 may be made of steel, brass or tin. The face plate 15 is provided at the front end of the cylindrical portion 13 of the housing 12. The face plate 15 may be made of any suitable material such as steel, brass or tin. Mounting holes 16 are provided through the face plate 15.

As shown in FIG. 4, an upper opening 20 is provided in the housing 12. The opening 20 includes a front edge 21 and a back edge 22. Opposing slots 23 and 24 are provided in the rectangular portion 14 of the housing 12. Holes 26 and 27 are provided through the rectangular portion 14 of the housing. The holes 26 and 27 are preferably positioned such that they are compatible with conventional door hardware such as mounting screws (not shown).

In the embodiment shown in FIG. 4, the housing 12 and internal components of the door latch 10 are designed such that the door latch 10 will fit within a standard door having predrilled cut-outs for a dead bolt. Standard door borings include a 2⅛ inch diameter circular cut-out through the face of the door which is set back either 2¾ inch or 2⅜ inch from the edge of the door. A 1 inch diameter circular cut-out is bored perpendicularly from the edge of the door into the larger cut-out. Conventional manual tubular dead bolts fit within these standard cut-outs. In accordance with a preferred embodiment of the present invention, the automatic door latch 10 can be installed in such standard predrilled cut-outs without modifying the door. This permits the automatic door latch 10 to be installed as easily as conventional manual dead bolt locks, either as an original installation or as a replacement for an existing manual dead bolt lock. The automatic door latch of the present invention may also include an adjustable backset mechanism which allows the dead bolt to be mounted in either a standard 2¾ inch or 2⅜ inch backset cut-out. Furthermore, the automatic door latch 10 is preferably adapted for mounting in both righthand and lefthand doors.

As described previously, the door latch 10 includes a dead bolt 30 which can be extended from the housing 12. The dead bolt 30 may be made of any suitable material such as metal. For example, the dead bolt 30 may be made of steel, iron, brass or chrome. Preferably, the dead bolt 30 comprises a substantially solid piece of metal which provides increased strength and security. The dead bolt 30 preferably comprises a symmetrical curved tip as shown in FIG. 4 in order to facilitate mounting of the door latch 10 in either righthand or lefthand doors.

As shown in FIGS. 5–9, a spring 32 fits inside a cylindrical recess 33 and biases the dead bolt 30 toward the extended position. Although a portion of the spring 32 fits inside the recess 33 in the dead bolt 30 in the embodiment of FIGS. 5–9, any other suitable arrangement may be used in order to bias the dead bolt 30 toward its extended position.

As shown most clearly in FIGS. 5–9, a contact member 40 is mounted on the dead bolt 30 inside the housing 12. The contact member 40 may be provided as a separate piece which is connected to the dead bolt 30 by any suitable means such as welding. Alternatively, the contact member 40 may be provided as an integral part of the dead bolt 30. The contact member 40 includes a contact surface 41 and a retainer 42. The contact surface 41 and retainer 42 are substantially planar and are connected together at an angle of less than 90 degrees, in the embodiment shown in FIGS. 5–9. The contact surface 41 and retainer 42 may be provided as a unitary piece as shown in FIGS. 5–9, or may be provided as separate pieces. The contact surface 41 of the contact member 40 may comprise a flat angled surface as shown in FIGS. 5–9. Alternatively, the contact surface 41 may be provided as a curved surface and/or may be provided with any other suitable angular orientation. As more fully described below, the contact member 40 is used in combination with a multi-position switch in order to retain the dead bolt 30 in various desired positions.

A projection 44 connected to the dead bolt 30 extends through the upper opening 20 in the housing 12. A slot 45 is provided through the top of the projection 44. As shown most clearly in FIGS. 4–9, a pin 46 extends from the rear of the projection 44 through the slots 23 and 24 in the housing 12. The pin 46 is preferably provided as a continuous bar of material extending through both of the slots 23 and 24 in the housing 12.

A rotatable swing arm 50 is received in the slot 45 of the projection 44 which, in turn, is connected to the dead bolt 30, as shown in FIGS. 4–9. The swing arm 50 is mounted on a rotatable bar 51 which passes through the rectangular portion 14 of the housing 12. A square hole 52 is provided through the bar 51 for receiving a dead bolt actuator (not shown). A disk 54 may be mounted on each end of the rotatable bar 51 outside of the rectangular portion 14 of the housing 12 in order to position the swing arm 50 in the desired rotational plane. Although the bar 51 and hole 52 shown in FIG. 4 have square cross sections, any other suitable geometry for the bar 51 and/or hole 52 may be used.

As shown in FIGS. 4–9, the automatic door latch 10 includes a multi-position switch 60 mounted inside the housing 12. The multi-position switch 60 includes an extension 62 adapted for engagement with the contact member 40. As more fully described below, the extension 62 is alternately movable from an extended position which holds the dead bolt 30 in the trigger position, to an intermediate position which allows the dead bolt 30 to be extended.

Figure 5:
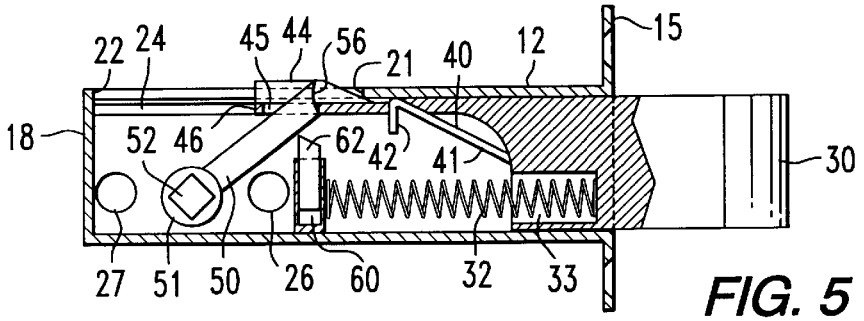
FIGS. 5–9 are partially schematic side sectional views of an automatic dead bolt lock in accordance with an embodiment of the present invention, showing the dead bolt in extended, partially retracted and fully retracted positions.

FIGS. 5–9 illustrate an automatic locking cycle in accordance with an embodiment of the present invention. In FIG. 5, the dead bolt 30 is in the extended locking position, similar to the position shown in FIG. 3. In the extended position, the spring 32 biases the dead bolt 30 to the locked position. In this position, the swing arm 50 which extends through the slot 45 is rotated to the right position shown in FIG. 5. The contoured end 56 of the swing arm 50 preferably contacts the right edge of the slot 45 to dog the dead bolt 30 in the locked position. In the dogged position shown in FIG. 5, a leftward force exerted on the dead bolt 30 is resisted by the engagement of the contoured end 56 of the swing arm 50 and the right edge of the slot 45.

In the position shown in FIG. 5, the extension distance of the dead bolt 30 is limited by contact between the projection 44 and the front edge 21 of the housing opening. In addition to, or in place of, the contact between the projection 44 and the front edge of the opening 21, extension of the dead bolt 30 may be limited by providing the swing arm 50 with a rotational stop position. Alternatively, the extension distance of the dead bolt 30 may be limited through contact between the pin 46 and the right side of the slot 24.

In the extended position illustrated in FIG. 5, the dead bolt 30 comprises a solid piece of material, such as steel or the like, extending from inside the face plate 15 to the tip of the bolt. The provision of a solid piece of material in this region makes it more difficult for the bolt to be sawed through or for the door to be kicked in, thereby increasing security of the lock.

Figure 6:
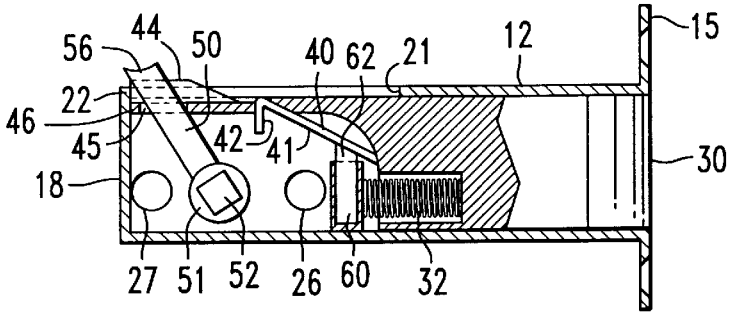

As shown in FIG. 6, the dead bolt 30 may be moved from the extended position shown in FIG. 5 to a fully retracted position in which the dead bolt 30 is positioned inside the housing 12. This is achieved by rotating the swing arm 50 counterclockwise to the left position shown in FIG. 6. Such rotation of the swing arm 50 may be accomplished, for example, by turning a key from outside of the door in which the dead bolt lock is mounted, or by turning a finger turn or key from inside of the door. As the dead bolt 30 is drawn inward from the position shown in FIG. 5 to the position shown in FIG. 6, the contact surface 41 of the contact member 40 engages the extension 62 of the multi-position switch 60. As explained more fully below, depression of the extension 62 from the position shown in FIG. 5 to the position shown in FIG. 6 causes the extension 62 to subsequently move upward and to slide against the contact surface 41 of the contact member 40 when the dead bolt 30 and contact member 40 are moved from the position shown in FIG. 6 to the position shown in FIG. 7.

In the position shown in FIG. 6, rotational movement of the swing arm 50 in the counterclockwise direction is limited by contact between the swing arm 50 and the back wall 18 of the housing, the back edge 22 of the housing opening and/or through contact between the pin 46 and left side of the slot 24. Alternatively, counterclockwise rotational movement of the swing arm 50 may be limited through contact between the projection 44 and the back edge 22 of the housing opening.

Figure 7:
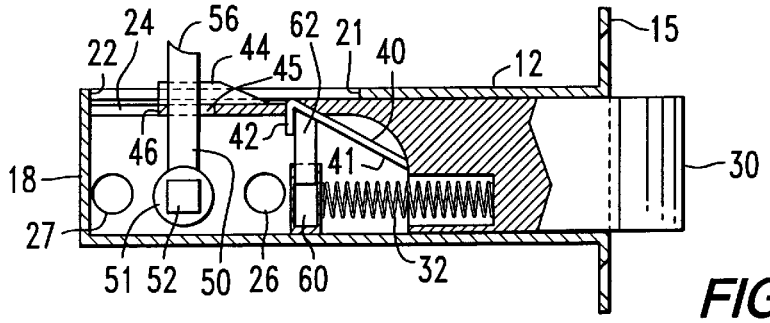

As shown in FIG. 6, the swing arm 50 preferably does not dog the dead bolt 30 in the fully retracted position, thereby allowing the dead bolt 30 to automatically move under the force of the spring 32 to the trigger position shown in FIG. 7. This is in contrast with the dogged position shown in FIG. 5, wherein the contoured end 56 of the swing arm contacts the right edge of the slot 45.

In FIG. 7, the extension 62 is in the extended position and engages the retainer 42 of the contact member 40, thereby positioning the dead bolt 30 in the partially retracted or trigger position. At this stage, the door in which the automatic door latch is mounted is in an open position, similar to that shown in FIG. 1.

Figure 8:
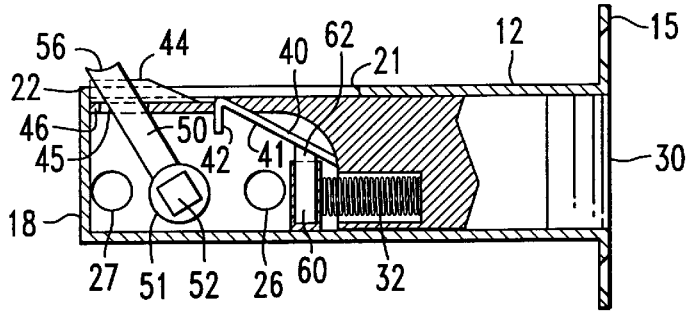
Figure 9:
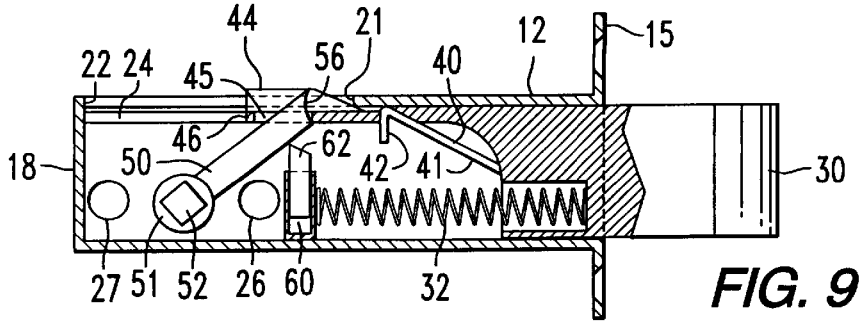

When the door is subsequently closed, the dead bolt 30 is forced inward from the trigger position shown in FIG. 7 to a retracted position as shown in FIG. 8. Movement of the dead bolt 30 from the trigger position to the retracted position is also shown in FIGS. 1 and 2. Although the dead bolt 30 shown in FIG. 8 is fully retracted into the housing 12, such full retraction is not absolutely necessary in accordance with the present invention. As most clearly shown in FIG. 2, as the door 8 closes, the dead bolt 30 contacts the strike plate 4 and is forced inward into the housing 12. As shown in FIG. 8, such inward movement of the dead bolt 30 depresses the extension 62 of the multi-position switch 60 through sliding engagement with the contact surface 41 of the contact member 40. Such depression of the extension 62 causes the extension 62 to move to an intermediate position, as shown in FIG. 9. In the intermediate position, the extension 62 clears the retainer 42, thereby allowing the dead bolt 60 to move rightward under the force of the spring 32 to the extended position shown in FIG. 9. The fully extended or locked position is also shown in FIG. 3.

As shown in FIGS. 5–9, the various rotational positions of the swing arm 50 and the various extended and retracted positions of the dead bolt 30 preferably do not block or interfere with the mounting holes 26 and 27. Thus, the door latch may be used with conventional mounting screws.

Although the multi-position switch 60 shown in FIGS. 5–9 operates through linear movement of the extension 62 in a vertical direction, any other suitable orientation or type of multi-position switch may be used. For example, the multi-position switch may undergo linear movement in a direction other than the vertical direction shown in FIGS. 5–9. In addition to the linear movement of the extension 62 shown in FIGS. 5–9, the multi-position switch may move to multiple rotational positions or the like. Furthermore, the contact member 40 may be provided in any other suitable geometry or orientation for contact with the multi-position switch. For example, the angle of the contact surface 41 and/or retainer 42 may be adjusted to any desirable orientation. Furthermore, instead of a flat contact surface 41 as shown in FIGS. 5–9, the contact surface may be curved or may be of any other suitable shape. If a rotating multi-position switch is used, the contact member 40 may be modified in order to contact the multi-position switch in different angular orientations.

Figure 10:
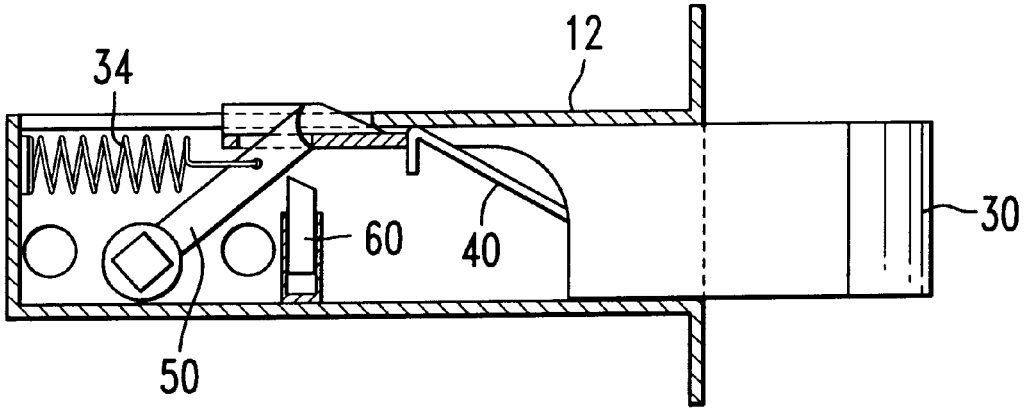
FIG. 10 is a partially schematic side sectional view of an automatic dead bolt lock in accordance with another embodiment of the present invention.
Figure 11:
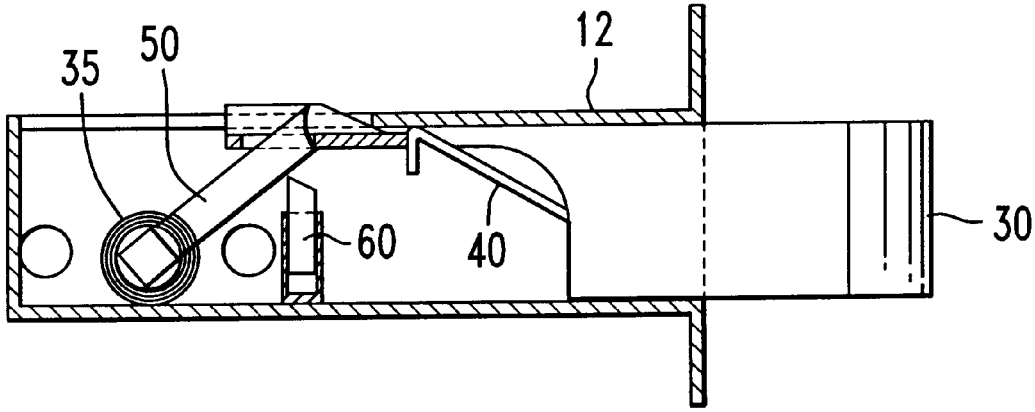
FIG. 11 is a partially schematic side sectional view of an automatic dead bolt lock in accordance with a further embodiment of the present invention.

FIGS. 10 and 11 illustrate alternative spring arrangements for biasing the dead bolt 30 in accordance with the present invention. In the embodiment shown in FIG. 10, a spring 34 is connected between the housing 12 and swing arm 50 in order to force the swing arm 50 clockwise to its right position, to thereby extend the dead bolt 30. In the embodiment shown in FIG. 11, a coil spring 35 engages the swing arm 50 in order to force the swing arm clockwise to its right position.

FIGS. 12–15 schematically illustrate the components and operation of the multi-position switch 60 in accordance with an embodiment of the present invention. The multi-position switch 60 includes an extension 62 which can be moved downward from the extended position shown in FIG. 12 to a depressed position shown in FIG. 14. Subsequently, the extension 62 moves from the depressed position shown in FIG. 14 to an intermediate position shown in FIG. 15. Further depression of the extension 62 from the position shown in FIG. 15 results in movement of the extension 62 back to the extended position shown in FIG. 12.

The multi-position switch 60 includes a housing 61 which receives the extension 62. The housing 61 and extension 62 may be made of any suitable material such as plastic, metal or the like. An extension spring 63 mounted in the housing 61 biases the extension 62 toward its extended position. A substantially non-rotatable serrated disk 64 is mounted inside the housing 61 by means of mounting springs 65 and 66. Although mounting springs 65 and 66 are shown in FIGS. 12–15, any other suitable means may be used to mount the substantially non-rotatable serrated disk 64 inside the housing 61. Preferably, the mounting is compliant and permits some degree of axial movement between the disk 64 and the housing 61.

The housing 61 includes a series of axially aligned channels formed in the inner wall thereof. Upper channels 71 extend from the upper opening of the housing 61 approximately midway into the housing 61. Radial projections 72 mounted on the extension 62 are slidably received within the upper channels 71. The upper channels 71 include upper stops which keep the radial projections 72 in the channels. The engagement of the radial projections 72 in the upper channels 71 permits the extension 62 to move axially with respect to the housing 61, but substantially prevents rotation of the extension 62 within the housing 61.

The housing 61 also includes a series of long channels 74 spaced around the inner circumference of the housing 61. In addition, multiple short channels 76 are positioned around the inner circumference of the housing 61, between the long channels 74. The long and short channels 74 and 76 include openings at their lower ends comprising angled faces 78.

As shown in FIGS. 12–15, a serrated disk 82 is rotatably mounted at the bottom of the extension 62 by means of a rotatable connection 84. The rotatable connection 84 shown in FIGS. 12–15 comprises a generally hemispherical recess in the bottom of the extension 62 which receives a projection extending from the top of the serrated disk 82, including a dome-shaped member which fits inside the generally hemispherical recess. However, any other suitable type of rotatable connection between the extension 62 and the serrated disk 82 may be used.

The rotatable serrated disk 82 includes projections 86 extending radially outward therefrom. The projections 86 preferably include angled faces 88. Depending upon the rotational orientation of the rotatable serrated disk 82 within the housing 61, the radial projections 86 may be received within the long channels 74, or may be received within the short channels 76.

Figure 12:
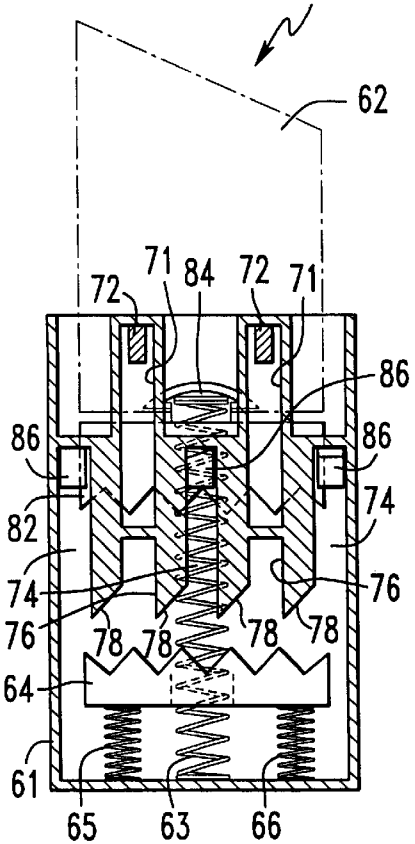

In FIG. 12, the extension 62 of the multi-position switch 60 is positioned in the extended position. In this extended position, the radial projections 86 on the rotatable disk 82 are located at the top of the long channels 74. Also, the radial projections 72 on the extension 62 are located at the top of the upper channels 71.

Figure 13:
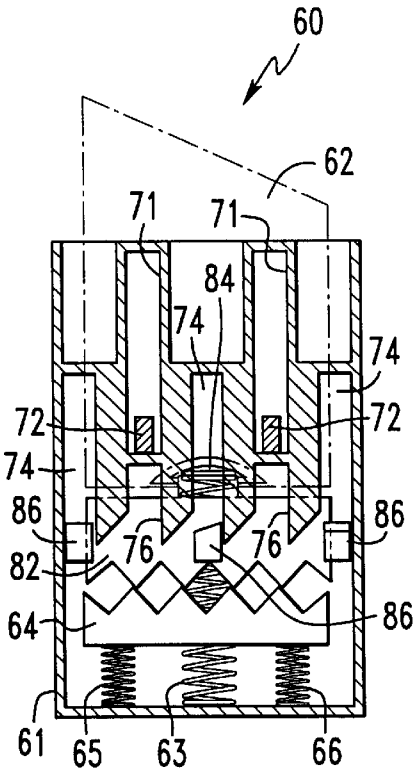

Depression of the extension 62 from the extended position shown in FIG. 12 to the position shown in FIG. 13 causes engagement between the teeth of the non-rotatable serrated disk 64 and the teeth of the rotatable serrated disk 82. Further depression of the extension 62 from the position shown in FIG. 13 to the fully depressed position shown in FIG. 14 causes the teeth of the serrated disks 64 and 82 to mate with each other. Since the disk 64 is substantially non-rotatable and the disk 82 is free to rotate, engagement between their respective teeth causes rotation of the radial projections 86 from the position shown in FIG. 13 to the position shown in FIG. 14. When pressure against the top surface of the extension 62 is released, the extension spring 63 forces the extension 62 and rotatable serrated disk 82 upward. Due to the rotational alignment of the radial projections 86 with respect to the short channels 76 shown in FIG. 14, upward movement of the extension 62 results in engagement between the angled faces 78 of the short channels 76 and the angled faces 88 of the radial projections 86. Further upward movement of the extension 62 to the position shown in FIG. 15 causes the radial projections 86 to slide to the top of the short channels 76. In this position, due to the contact between the radial projections 86 and the tops of the short channels 76, the extension 62 is held in an intermediate axial position in relation to the housing 61.

Figure 15:
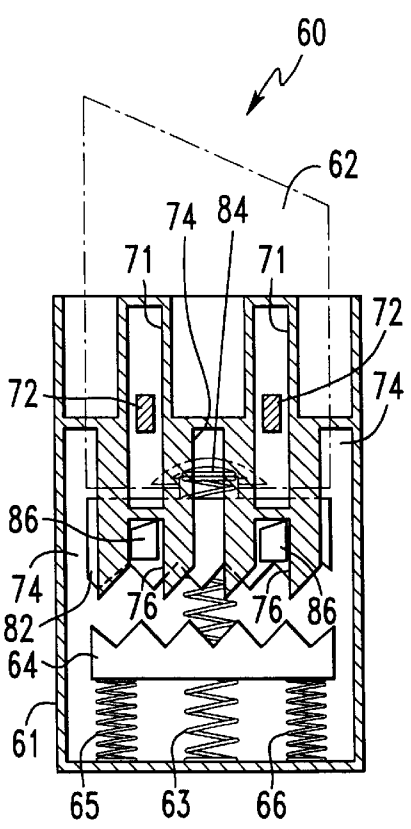
FIGS. 12–15 are partially schematic side sectional views of a multi-position switch for use in an automatic dead bolt lock in accordance with an embodiment of the present invention.
Figure 14:
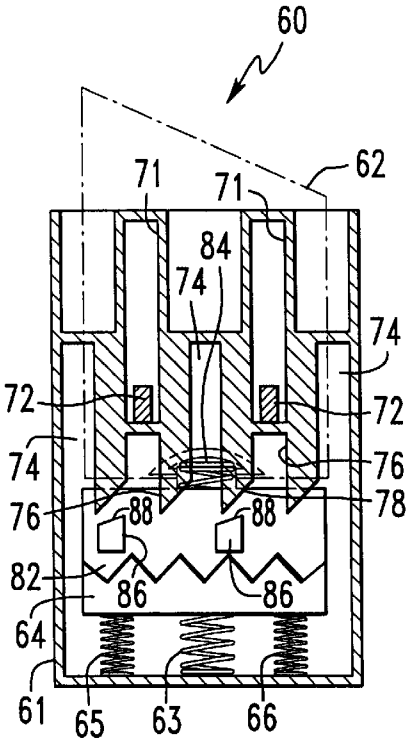

Although not shown in the figures, if the extension 62 is depressed from the intermediate position shown in FIG. 15 to cause engagement of the teeth of the serrated disks 64 and 82, the radial projections 86 will be rotated to an angular orientation below the openings of the long channels 74. If pressure is subsequently removed from the top surface of the extension 62, the radial projections 86 will travel upward to the tops of the long channels 74, to a position similar to that shown in FIG. 12. In this manner, the multi-position switch 60 is alternately located in the extended position or in the intermediate position through repeated depression of the extension 62.

In accordance with another aspect of the present invention, a door latch restraint assembly is provided. FIGS. 16–22 illustrate an embodiment of a dead bolt restraint assembly 110. The assembly 110 includes a dead bolt actuator bar 111, which may be inserted in the hole 52 of the dead bolt lock shown in FIG. 4. Alternatively, the dead bolt actuator bar 111 may be used in combination with any other suitable type of automatic door latch arrangement. As shown most clearly in FIGS. 16–18, a dead bolt finger turn 112 is connected to the dead bolt actuator bar 111 in order to rotate the dead bolt actuator bar 111. Alternatively, the finger turn 112 could be replaced by a key or knob set. The restraint assembly 110 includes an interior door face plate 114 through which the dead bolt finger turn 112 extends. An opening 115 is provided in the door face plate 114.

As shown most clearly in FIGS. 16–20, a keeper 116 is mounted on the dead bolt actuator bar 111 for rotation therewith. The keeper 116 includes at least one keeper slot 118. Preferably, two keeper slots are provided, as shown in FIGS. 16–20, in order to allow mounting in both lefthand and righthand doors.

Figures 16, 17, 18:
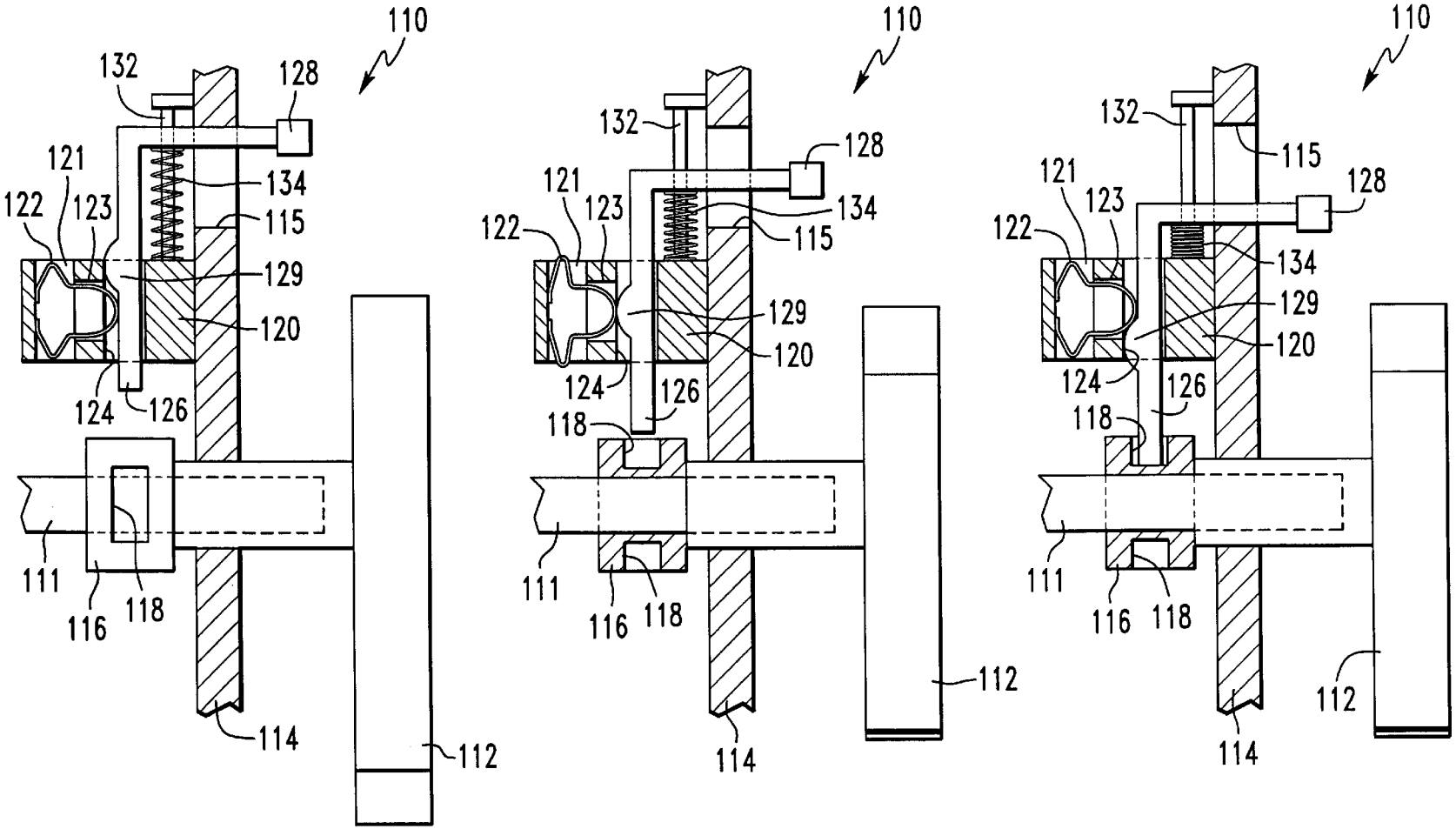
FIGS. 16–18 are partially schematic end sectional views of a dead bolt restraint assembly in accordance with an embodiment of the present invention.
Figure 20:
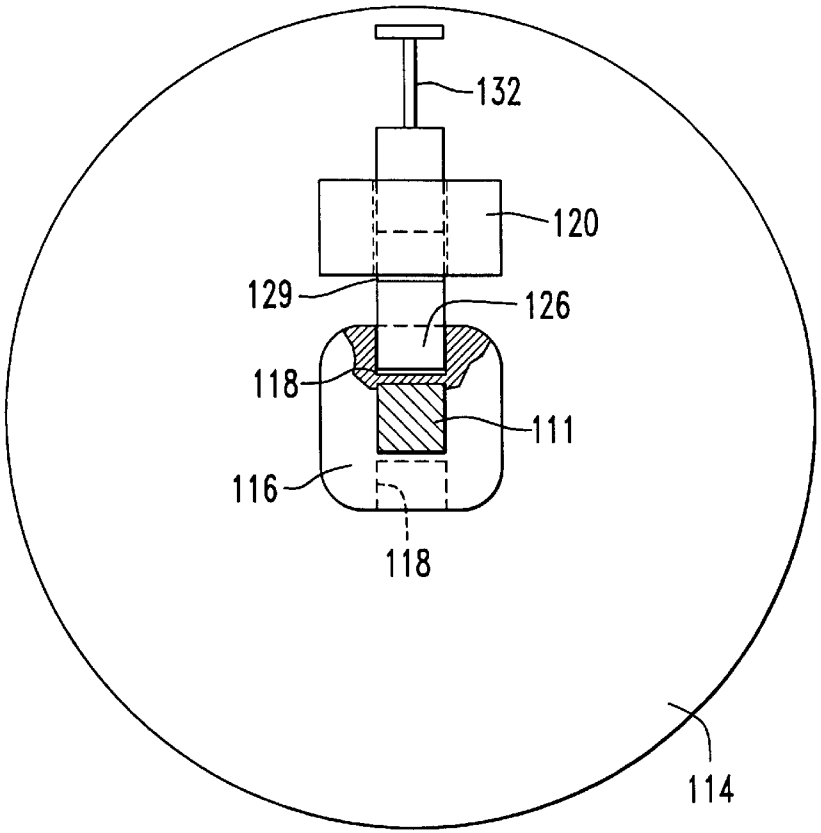
FIGS. 19 and 20 are partially schematic interior side views of the dead bolt restraint assembly shown in FIGS. 16–18.

As shown in FIGS. 16–18, a bracket 120 is mounted on the inside surface of the door face plate 114. The bracket 120 includes a chamber 121 which houses a contoured leaf spring 122. A portion of the leaf spring 122 extends through an opening 123 in the bracket 120. The bracket 120 also includes a latch channel 124 which receives a movable latch 126. The latch 126 is connected to a button 128 by an arm which extends through the opening 115 in the face plate 114. The latch 126 includes a bump 129 which passes through the latch channel 124 and engages the leaf spring 122.

The latch 126 is guided by a support rail 132 mounted between the interior surface of the door face plate 114 and the bracket 120. A spring 134 contacts the bracket 120 and the latch 126 to thereby bias the latch into an upper or disengaged position, as shown in FIG. 16.

Figure 19:
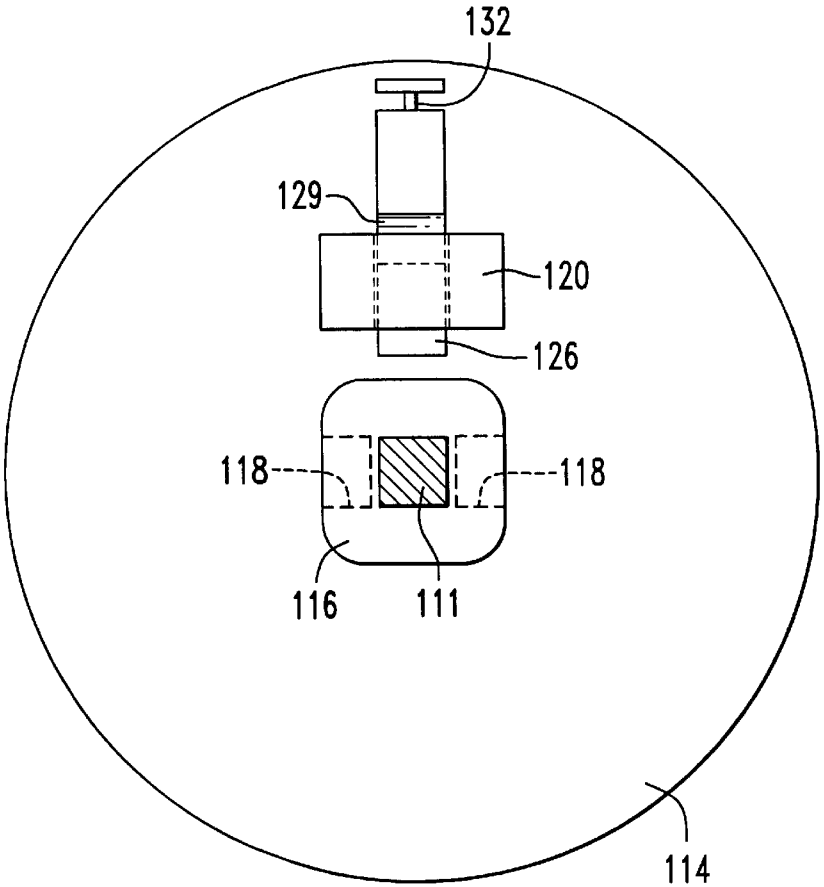
Figure 21:
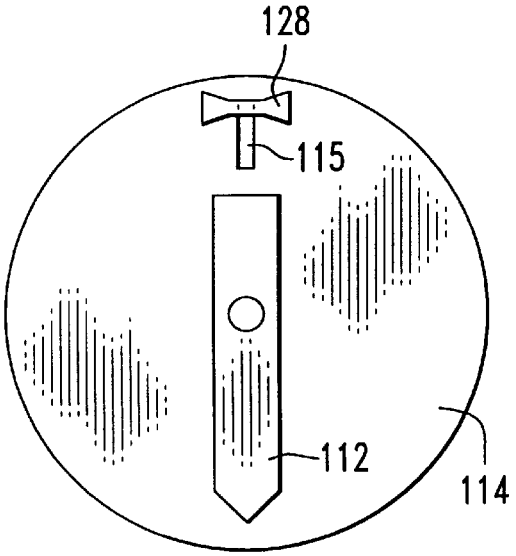
FIGS. 21 and 22 are partially schematic plan views showing a dead bolt lock handle and a dead bolt restraint button in accordance with an embodiment of the present invention.
Figure 22:
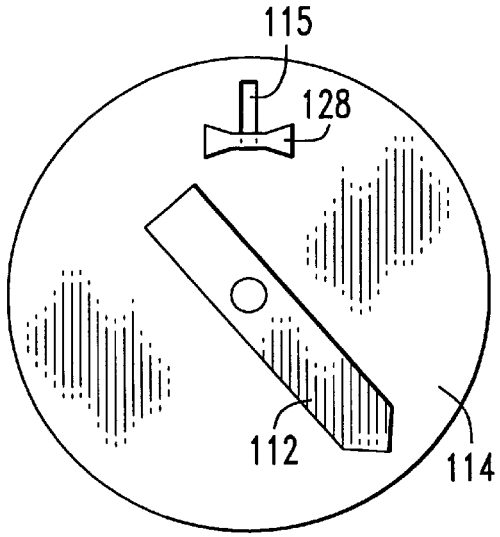

In the position shown in FIG. 16, the deadbolt restraint assembly 110 is in the disengaged position, wherein the latch 126 is clear of the keeper 116. This disengaged position is also shown in FIGS. 19 and 21. If the latch 126 is moved downward while the finger turn 112 and keeper 116 are in the positions shown in FIG. 16, the latch 126 does not enter the slot 118 and does not prevent rotation of the keeper 116. Therefore, the restraint assembly 110 will not jam the dead bolt in the trigger or extended positions. However, when the finger turn 112 is rotated to the position shown in FIGS. 17, 18 and 22, the latch 126 may be moved downward into the slot 118 of the keeper 116. Such movement is achieved by downward pressure on the button 128 against the force of the spring 134. During the downward movement of the latch 126, the bump 129 contacts the leaf spring 122 as shown in FIG. 17. Further downward movement of the latch 126 causes the bump 129 to pass the leaf spring 122, to thereby hold the latch 126 inside the slot 118, as shown in FIG. 18. In this position, contact between the leaf spring 122 and the bump 129 counteracts the force of the spring 134 and prevents the latch 126 from disengaging from the slot 118 until the button 128 is manually moved upward.

The door latch restraint assembly in accordance with an embodiment of the present invention allows an automatic door latch such as an automatic dead bolt lock to be held in a fully retracted or unlocked position when use of the dead bolt is not desired. For example, the dead bolt restraint assembly 110 may be used in combination with the automatic door latch 10 described previously. In this case, the dead bolt actuator bar 111 shown in FIGS. 16–20 may be inserted in the hole 52 shown in FIGS. 4–9. The dead bolt actuator bar 111 may be used, in combination with the finger turn 112, to move the swing arm 50 from the position shown in FIG. 5 to the position shown in FIG. 6. When the swing arm 50 is in the position shown in FIG. 6, the dead bolt actuator bar 111 and finger turn 112 are in the positions shown in FIGS. 17, 18 and 22. In this position, the latch 126 of the dead bolt restraint assembly 110 may be moved to the position shown in FIGS. 18 and 20. By locking the dead bolt actuator bar 111 against rotation, the swing arm 50 may be locked in the position shown in FIG. 6. As a result, the dead bolt 30 is held in the fully retracted position.

The present invention provides several advantages in comparison with conventional automatic dead bolt designs. For example, the present dead bolt lock has relatively few component parts, which reduces the cost of the lock and also reduces susceptibility to damage or failure during installation and use. Furthermore, in accordance with a preferred embodiment, the components of the present dead bolt lock, such as the contact member and multi-position switch, are substantially contained within the lock housing. This prevents damage to the lock, particularly during installation. The use of a substantially solid bolt provides increased security. The ability of the present dead bolt lock to be installed in both righthand and lefthand doors is also advantageous. Furthermore, the preferred automatic dead bolt lock does not require a mortise assembly for mounting on a door, and is compatible with standard predrilled door cut-outs. The automatic dead bolt lock may therefore be installed in standard predrilled cut-outs without the necessity of making additional borings or other modifications to the door. In addition, the latch restraint assembly in accordance with an embodiment of the present invention allows an automatic dead bolt lock to be manually disengaged. Thus, the dead bolt can be held in a fully retracted position when use of the dead bolt is not desired.

Whereas particular embodiments of this invention have been described above for purposes of illustration, it will be evident to those skilled in the art that numerous variations of the details of the present invention may be made without departing from the invention as defined in the following claims.

What is claimed is:

1. An automatic door latch comprising:

a housing;

a latch retractably mounted in the housing and movable to an extended position, a partially retracted position, and a fully retracted position;

a spring biasing the latch toward the extended position;

an actuator for moving the latch to the fully retracted position;

a contact member mounted on the latch and moveable therewith; and a multi-position switch mounted on the housing in releasable contact with the contact member for allowing the latch to move to the extended position when the multi-position switch is in a first position, and for holding the latch in the partially retracted position when the multi-position switch is in a second position.

2. The automatic door latch of claim 1, wherein the latch comprises a dead bolt.

3. The automatic door latch of claim 2, wherein the dead bolt comprises a substantially solid piece of metal.

4. The automatic door latch of claim 2, wherein when the dead bolt is in the extended position, a portion of the dead bolt extending from the housing comprises a single solid piece of metal.

5. The automatic door latch of claim 2, wherein the dead bolt comprises a substantially symmetrical curved tip.

6. The automatic door latch of claim 1, wherein the actuator comprises a rotatable swing arm pivotally mounted in the housing engaging the latch.

7. The automatic door latch of claim 6, wherein the swing arm engages a projection mounted on the latch.

8. The automatic door latch of claim 7, wherein the swing arm is received in a slot in the projection.

9. The automatic door latch of claim 7, wherein the projection comprises a pin extending from the projection which is slidably received in at least one slot extending through the housing.

10. The automatic door latch of claim 1, wherein the contact member is mounted inside the housing.

11. The automatic door latch of claim 1, wherein the contact member comprises a contact surface in releasable sliding engagement with the multi-position switch.

12. The automatic door latch of claim 11, wherein the contact surface is substantially planar.

13. The automatic door latch of claim 12, wherein the contact surface extends in a plane that is not parallel with an extension direction of the latch.

14. The automatic door latch of claim 11, wherein the contact member further comprises a retainer in releasable contact with the multi-position switch.

15. The automatic door latch of claim 14, wherein the retainer comprises a substantially planar surface which extends in a plane that is substantially perpendicular to an extension direction of the latch.

16. The automatic door latch of claim 14, wherein the contact surface and the retainer are substantially planar and are connected together at an angle of less than 90 degrees.

17. The automatic door latch of claim 1, wherein the multi-position switch is mounted inside the housing.

18. The automatic door latch of claim 1, wherein the multi-position switch comprises an extension in releasable contact with the contact member.

19. The automatic door latch of claim 18, wherein the extension is movable in a linear direction from the first position to the second position.

20. The automatic door latch of claim 19, wherein the extension is retractably mounted in a housing of the multi-position switch, and the extension is movable to an extended position in relation to the housing which corresponds to the second position.

21. The automatic door latch of claim 20, wherein the extension is movable to an intermediate position in relation to the housing which corresponds to the first position.

22. The automatic door latch of claim 19, wherein the linear direction is not parallel with the extension direction of the latch.

23. The automatic door latch of claim 19, wherein the linear direction is substantially perpendicular to the extension direction of the latch.

24. The automatic door latch of claim 1, wherein the latch comprises a dead bolt and the contact member and multi-position switch are mounted inside the housing.

25. The automatic door latch of claim 1, wherein the latch comprises a dead bolt and the automatic door latch is adapted for installation in a standard predrilled dead bolt lock cut-out in a door.

26. The automatic door latch of claim 1, wherein the automatic door latch is adapted for installation in both a righthand and a lefthand door.

27. An automatic door latch comprising:

a housing adapted for mounting in a door;

a latch retractably mounted in the housing and movable to an extended position, a partially retracted trigger position, and a fully retracted position;

a spring biasing the latch toward the extended position;

means mounted inside the housing for holding the latch in the partially retracted trigger position when the door is open, and for allowing the latch to move to the extended position when the door is closed, wherein said means mounted inside the housing remains inside the housing when the latch is in the extended position; and means for dogging the latch in the extended position.

28. The automatic door latch of claim 27, wherein the latch is a dead bolt comprising a single solid piece of metal extending from the housing when the dead bolt is in the extended position.

29. The automatic door latch of claim 27, wherein said means mounted inside the housing comprises:

a contact member mounted on the latch; and a multi-position switch mounted on the housing in releasable contact with the contact member.

30. The automatic door latch of claim 29, wherein the contact member and multi-position switch comprise means for allowing the latch to move to the extended position when the multi-position switch is in a first position, and for holding the latch in the partially retracted trigger position when the multi-position switch is in a second position.

31. The automatic door latch of claim 27, further comprising means for installing the automatic door latch in a standard predrilled dead bolt lock cut-out in the door.

32. The automatic door latch of claim 27, further comprising means for installing the automatic door latch in both a righthand and a lefthand door.

* * * * *